US010637126B2

(12) United States Patent
Lee et al.

(10) Patent No.: US 10,637,126 B2
(45) Date of Patent: Apr. 28, 2020

(54) ANTENNA AND ELECTRIC DEVICE USING THE SAME

(71) Applicant: ASUSTeK COMPUTER INC., Taipei (TW)

(72) Inventors: Cheng-Tse Lee, Taipei (TW); Saou-Wen Su, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 0 days.

(21) Appl. No.: 15/376,682

(22) Filed: Dec. 13, 2016

(65) Prior Publication Data

US 2017/0170543 A1 Jun. 15, 2017

(30) Foreign Application Priority Data

Dec. 15, 2015 (TW) ..... 104142046 A

(51) Int. Cl.
*H01Q 1/48* (2006.01)
*H01Q 1/22* (2006.01)
*H01Q 9/04* (2006.01)

(52) U.S. Cl.
CPC ..... *H01Q 1/2266* (2013.01); *H01Q 1/48* (2013.01); *H01Q 9/0421* (2013.01)

(58) Field of Classification Search
CPC ..... H01Q 1/2266; H01Q 1/48; H01Q 9/0421; H01Q 5/371; H01Q 9/42; H01Q 1/38; H01Q 1/243
See application file for complete search history.

(56) References Cited

U.S. PATENT DOCUMENTS 6,809,689 B1 * 10/2004 Chen ..... H01Q 9/0421 343/700 MS
9,048,532 B2 6/2015 Yu et al.
2002/0190905 A1 * 12/2002 Flint ..... H01Q 1/22 343/702
2004/0104853 A1 * 6/2004 Chen ..... G06F 1/1616 343/702

(Continued)

FOREIGN PATENT DOCUMENTS

CN 1832256 9/2006
CN 103811853 5/2014

*Primary Examiner* — Dieu Hien T Duong
*Assistant Examiner* — Bamidele A Jegede
(74) *Attorney, Agent, or Firm* — JCIPRNET

(57) ABSTRACT

An antenna is provided. The antenna includes: an antenna ground plane; a radiating unit parallel to the antenna ground plane, the radiating unit including: a common unit; a first branch extended from the common unit along a first direction; a second branch extended from the common unit along a second direction, wherein the first direction and the second direction are inverse; a third branch separated from the first branch and the second branch and extending outwardly from the common unit; a shorting unit located between a plane of radiating unit located and a plane of the antenna ground plane and connected to the common unit and the antenna ground plane; and a feeding unit located between a plane of the radiating unit and a plane of the antenna ground plane, wherein the feeding unit is separated from the shorting unit and connected to the third branch, and the shorting unit and the feeding unit are located on the same side.

15 Claims, 4 Drawing Sheets

(56) References Cited

U.S. PATENT DOCUMENTS

2004/0125026 A1* 7/2004 Pathak ..... H01Q 1/24 343/702
2005/0093752 A1* 5/2005 Cheng ..... G06F 1/1616 343/702
2005/0134509 A1* 6/2005 Lin ..... H01Q 1/243 343/702
2005/0243006 A1* 11/2005 Lin ..... H01Q 9/0421 343/770
2006/0145924 A1* 7/2006 Chen ..... H01Q 1/243 343/700 MS
2007/0008224 A1* 1/2007 Chung ..... H01Q 1/243 343/700 MS
2007/0030198 A1* 2/2007 Wei ..... H01Q 9/42 343/700 MS
2007/0103367 A1* 5/2007 Wang ..... H01Q 9/42 343/700 MS
2007/0109200 A1* 5/2007 Su ..... H01Q 1/243 343/700 MS
2007/0120753 A1* 5/2007 Hung ..... H01Q 1/243 343/702
2007/0139270 A1* 6/2007 Takei ..... H01Q 1/243 343/700 MS
2007/0229358 A1* 10/2007 Chi ..... H01Q 1/243 343/700 MS
2008/0150829 A1* 6/2008 Lin ..... G06F 1/1616 343/860
2008/0180327 A1* 7/2008 Lin ..... H01Q 1/2266 343/700 MS
2008/0180333 A1* 7/2008 Martiskainen ..... H01Q 1/243 343/722
2008/0266187 A1* 10/2008 Chang ..... H01Q 1/243 343/700 MS
2008/0278382 A1* 11/2008 Hung ..... H01Q 1/2291 343/700 MS
2009/0073060 A1* 3/2009 Shimasaki ..... G06F 1/1616 343/702
2009/0115664 A1* 5/2009 Chung ..... H01Q 1/243 343/700 MS
2009/0262027 A1* 10/2009 Hsu ..... H01Q 9/0442 343/700 MS
2010/0103069 A1* 4/2010 Wang ..... H01Q 1/243 343/846
2010/0123631 A1* 5/2010 Chang ..... H01Q 1/243 343/700 MS
2010/0127941 A1* 5/2010 Chiang ..... H01Q 1/243 343/700 MS
2011/0012789 A1* 1/2011 Yang ..... H01Q 1/38 343/700 MS
2013/0021209 A1* 1/2013 Fan ..... H01Q 9/42 343/700 MS
2014/0049431 A1* 2/2014 Tai ..... H01Q 1/36 343/700 MS
2014/0139377 A1* 5/2014 Ruan ..... H01Q 1/2266 343/700 MS
2015/0061951 A1 3/2015 Wong et al.

* cited by examiner

ANTENNA AND ELECTRIC DEVICE USING THE SAME

CROSS-REFERENCE TO RELATED APPLICATION

This application claims the priority benefit of TW application serial No. 104142046, filed on Dec. 15, 2015. The entirety of the above-mentioned patent application is hereby incorporated by reference herein and made a part of specification.

BACKGROUND OF THE INVENTION

Field of the Invention

The present invention relates to an electronic unit and an electronic device, and more particularly, relates to an antenna and electronic device using the same.

Description of the Related Art

Antennas for wireless communication devices are usually disposed in clearance areas around the panel of the wireless communication devices, and a metal plate behind the panel is used as an antenna ground plane. Also, owing to the plastic back cover of the wireless communication devices, the antennas usually have good radiation performance. Recently, the devices having attractive appearance with the overall metallic back cover or housing have become trendy. However, the radiation performance of the antennas is easily affected, which resulting in signal interruption. Besides, the height of the antennas should also be reduced to conform to the slim wireless communication devices. The conventional antenna designs no longer satisfy the requirements of the products.

BRIEF SUMMARY OF THE INVENTION

According to first aspect of the disclosure, an antenna includes: an antenna ground plane; a radiating unit parallel to the antenna ground plane, the radiating unit including: a common unit; a first branch extended from the common unit along a first direction; a second branch extended from the common unit along a second direction, wherein the first direction and the second direction are inverse; a third branch separated from the first branch and the second branch and extending outwardly from the common unit; a shorting unit located between a plane of radiating unit located and a plane of the antenna ground plane and connected to the common unit and the antenna ground plane; and a feeding unit located between a plane of the radiating unit and a plane of the antenna ground plane, wherein the feeding unit is separated from the shorting unit and connected to the third branch, and the shorting unit and the feeding unit are located on the same side.

According to second aspect of the disclosure, an electronic device, includes: a housing, and an antenna, including: an antenna ground plane; a radiating unit parallel to the antenna ground plane, the radiating unit which includes: a common unit; a first branch extended from the common unit along a first direction; a second branch extended from the common unit along a second direction, wherein the first direction and the second direction are inverse; a third branch separated from the first branch and the second branch and extending outwardly from the common unit; a shorting unit located between a plane of radiating unit located and a plane of the antenna ground plane and connected to the common unit and the antenna ground plane; and a feeding unit located between a plane of the radiating unit and a plane of the antenna ground plane, wherein the feeding unit is separated from the shorting unit and connected to the third branch, the shorting unit and the feeding unit are located on the same side, and the antenna ground plane is located between the feeding unit and the housing.

BRIEF DESCRIPTION OF THE DRAWINGS

These and other features, aspects and advantages of the invention will become better understood with regard to the following embodiments and accompanying drawings.

DETAILED DESCRIPTION OF THE EMBODIMENTS

Figure 1:
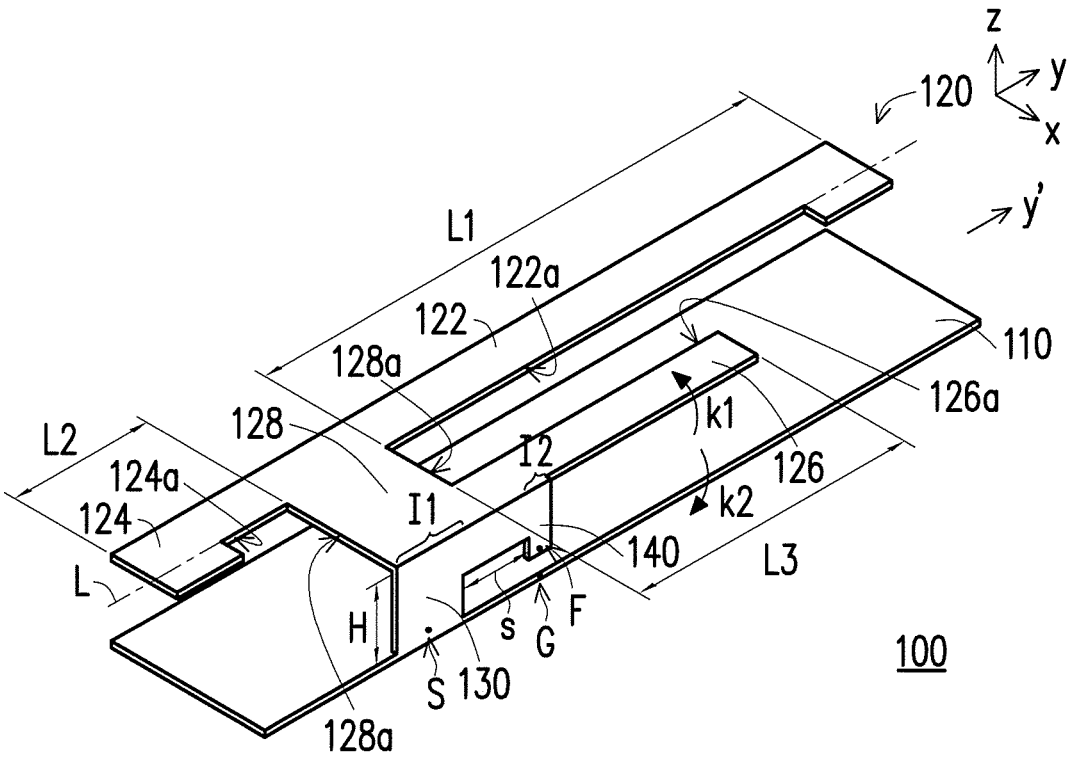
FIG. 1 is a perspective view of an antenna in an embodiment.

FIG. 1 is a perspective view of an antenna in an embodiment of the present invention. Referring to FIG. 1, an antenna 100 includes an antenna ground plane 110, a radiating unit 120, a shorting unit 130 and a feeding unit 140. The antenna ground plane 110 has a ground point G. In an embodiment, the antenna ground plane 110 is approximate to a quadrangle conductive plane, such as a rectangular conductive plate. The shape is not limited herein.

The radiating unit 120 is parallel to the antenna ground plane 110. The radiating unit 120 includes a first branch 122, a second branch 124, a third branch 126 and a common unit 128. In an embodiment, the first branch 122, the second branch 124, the third branch 126 and the common unit 128 are located on the same plane. The plane at which the first branch 122, the second branch 124, the third branch 126 and the common unit 128 are located (such as a x-y plane) is parallel to the plane of the antenna ground plane 110 (such as a plane under the x-y plane), which is not limited herein.

The first branch 122 extends from the common unit 128 along the y axis direction. The second branch 124 extends from the common unit along the −y axis direction. The y axis direction and the −y axis direction are inverse. In other words, the first branch 122 and the second branch 124 are located in different sides of the common unit 128 and extend in opposite directions y and −y, respectively. Further, in an embodiment, the first branch 122 and the second branch 124 are located at the same straight line, which is not limited herein. The first branch 122 and the second branch 124 are approximately long strips. The first branch 122 has a long side 122*a* perpendicular to the edge 128*a* of the common unit 128. The second branch 124 has a long side 124*a* perpendicular to the edge 128*a* of the common unit 128.

The third branch 126 is separated from the first branch 122 and the second branch 124 and extends outwardly from the common unit 128. For example, in an embodiment, the third branch 126 extends from the common unit 128 along the y' direction which is parallel to the y direction. In other words, the first branch 122 and the third branch 126 are located in the same side of the common unit 128 and extend along the parallel direction y, y', respectively. In an embodiment, the third branch 126 and the second branch 124 are not overlapped in the y direction. The third branch 126 is approximately a long strip. In an embodiment, a long side 126*a* of the third branch 126 is perpendicular to the edge 128*a* of the common unit 128.

The length of the first branch 122 is L1. The length of the second branch is L2. The length of the third branch 126 is L3. In an embodiment, the L1, L2 and L3 are different from each other to allow the antenna 100 to operate at multiple frequency bands. For example, in an embodiment, the L1 is greater than the L3, and the L3 is greater than the L2, which is not limited herein.

The shorting unit 130 is located between the plane of the radiating unit 120 and the plane of the antenna ground plane 110. The shorting unit 130 has a short point S. The shorting unit 130 is connected to the common unit 128 of the radiating unit 120 and the antenna ground plane 110. In an embodiment, the plane of the shorting unit 130 (for example, the plane is parallel to the y-z plane) is perpendicular to the antenna ground plane 110, which is not limited herein. Two opposite sides of the shorting unit 130 are directly connected to the common unit 128 of the radiating unit 120 and the antenna ground plane 110, respectively. The shorting unit 130 is electronically connected to the common unit 128 and the antenna ground plane 110.

The feeding unit 140 is located between the plane of the radiating unit 120 and the plane of the antenna ground plane 110. The feeding unit 140 has a feed point F. The feed point F is located above the ground point G. The feeding unit 140 is separated from the shorting unit 130. The feeding unit 140 is directly connected to the third branch 126 of the radiating unit 120 and doesn't contact with the antenna ground plane 110. In an embodiment, the feeding unit 140 and the shorting unit 130 are located on the same plane. The plane of the feeding unit 140 and the shorting unit 130 is perpendicular to the plane of the antenna ground plane 110, which is not limited herein.

Figure 2:
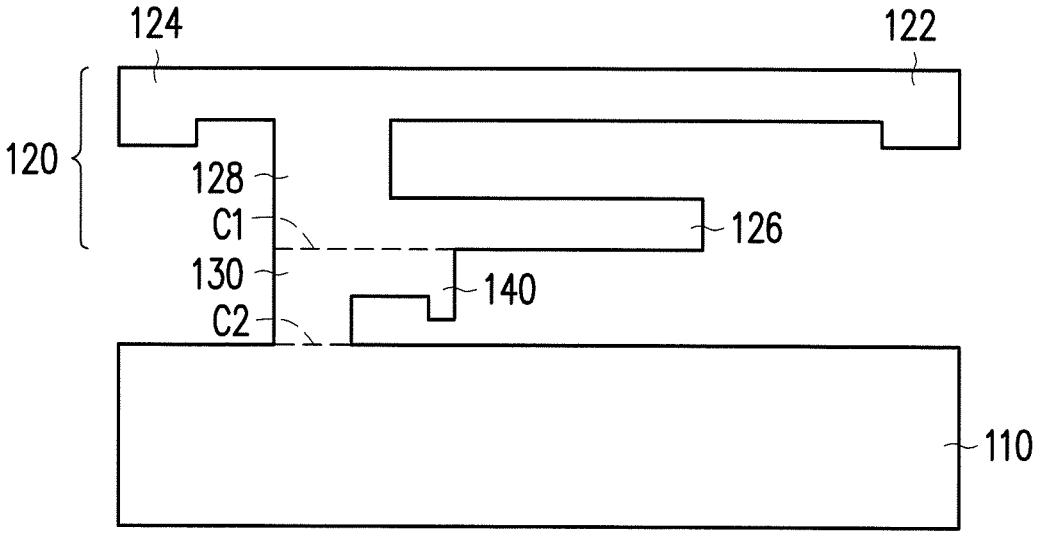
FIG. 2 is a schematic diagram of the antenna in FIG. 1 after unfolded.

The shorting unit 130 and the feeding unit 140 are located on the same side. In other words, if the common unit 128 and the third branch 126 are regarded as a piece (such as L type conductive piece), the shorting unit 130 and the feeding unit 140 are located at the same side of the piece and connected to the piece. In a word, the shorting unit 130 and the feeding unit 140 are located on the same side of the antenna 100. The high capacitive reactance value generated due to the reduction of the height H of the antenna 100 (the height H is the height between the antenna ground plane 110 and the radiating unit 120) can be compensated by adjusting the distance s (or the inductive reactance) between the shorting unit 130 and the feeding unit 140 which are at the same side. Consequently, good performance of the antenna 100 is obtained while the height H of the antenna 100 (such as less than 4 millimeter) is reduced. FIG. 2 is a schematic diagram of the antenna in FIG. 1 after unfolded. The antenna 100 of FIG. 1 can be formed by bending the conductive piece of FIG. 2. In other words, in the embodiment, the antenna ground plane 110, the radiating unit 120, the shorting unit 130 and the feeding unit 140 are integrally formed. Referring to FIG. 1 and FIG. 2, when the shorting unit 130 and the feeding unit 140 are parallel to the same plane, the radiating unit 120 is bent by 90 degrees along the bending line C1 toward the k1 direction, and the antenna ground plane 110 is bent by 90 degrees along the bending line C2 toward the k2 direction, the conductive piece in FIG. 2 is bent to form the antenna 100 in FIG. 1.

Figure 3:
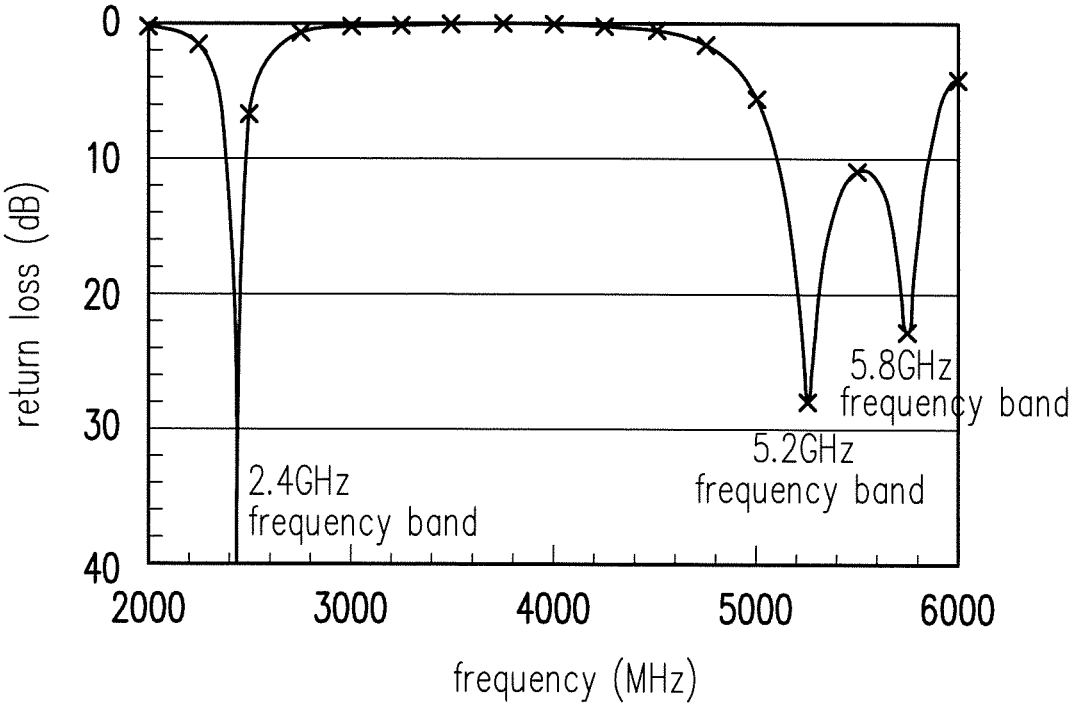
FIG. 3 is curve showing a return loss of an antenna in an embodiment.
Figure 4:
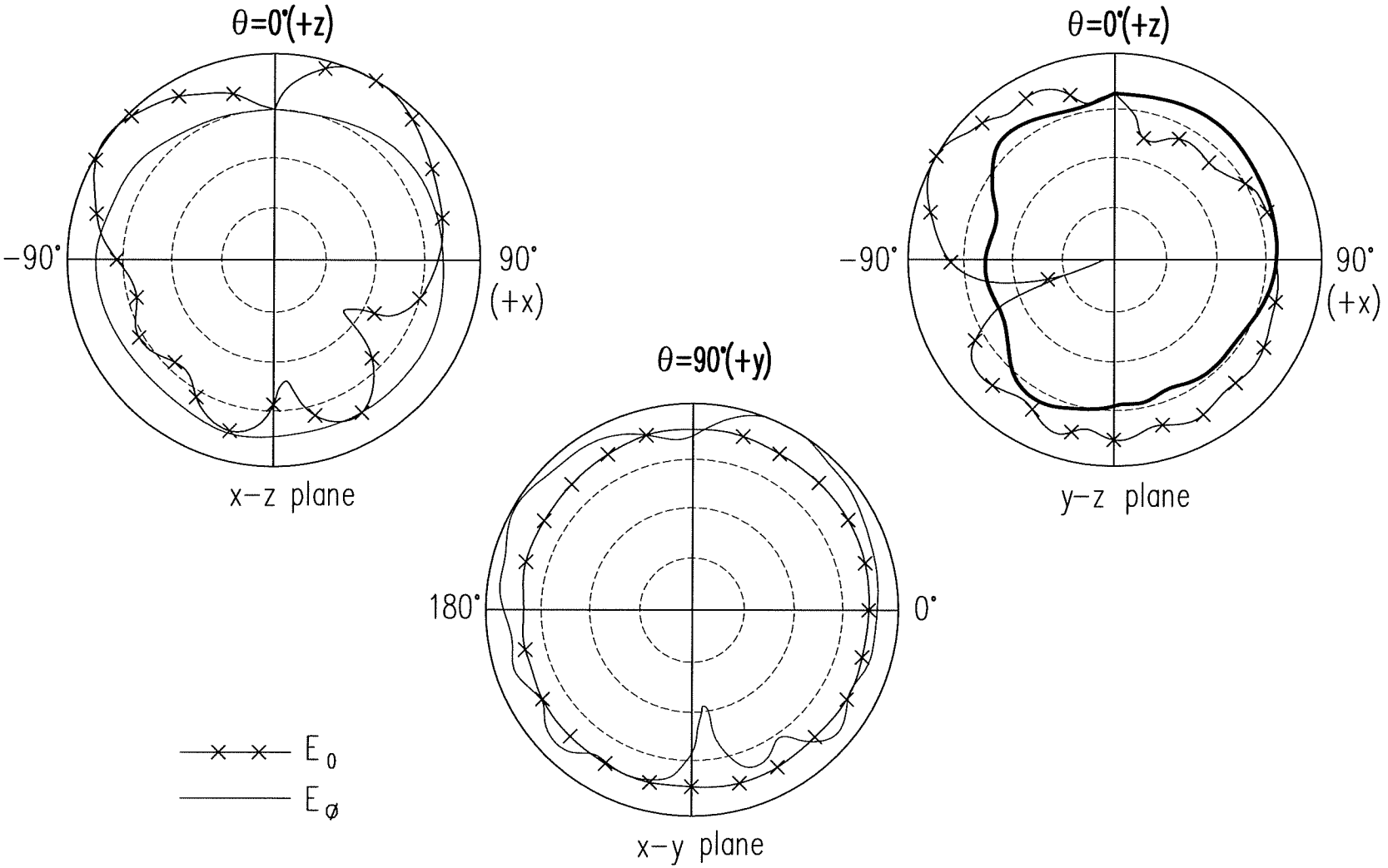
FIG. 4 is a field pattern of an antenna operated in the 2442 MHz center frequency of the 2.4 GHz frequency band in an embodiment.

FIG. 3 is a curve of showing a return loss of then antenna 100 according to an embodiment. Referring to FIG. 3, the antenna 100 of FIG. 1 can operate at the operating frequency band near 2.4 GHz (such as the operation frequency between 2400~2484 MHz) and 5 GHz operating band (such as the operation frequency between 5150~5825 MHz). Moreover, the impedance bandwidth of the antenna 100 can meet the requirement of the return loss of a specific decibel (dB). FIG. 4 is a radiation pattern of an antenna operated at 2442 MHz center frequency of 2.4 GHz frequency band in an embodiment. In FIG. 4, the stronger of the curve $E_0$ and the curve $E_\varphi$ is a main polarization curve, the weaker one is a cross polarization curve. As seen the radiation pattern of the x-z plane, the y-z plane and the x-y plane in FIG. 4, when the antenna 100 is operated at 2442 MHz center frequency, the antenna 100 is a quasi-omnidirectional antenna. As shown in FIG. 4, the antenna 100 with slim height still has a good performance.

Figure 5:
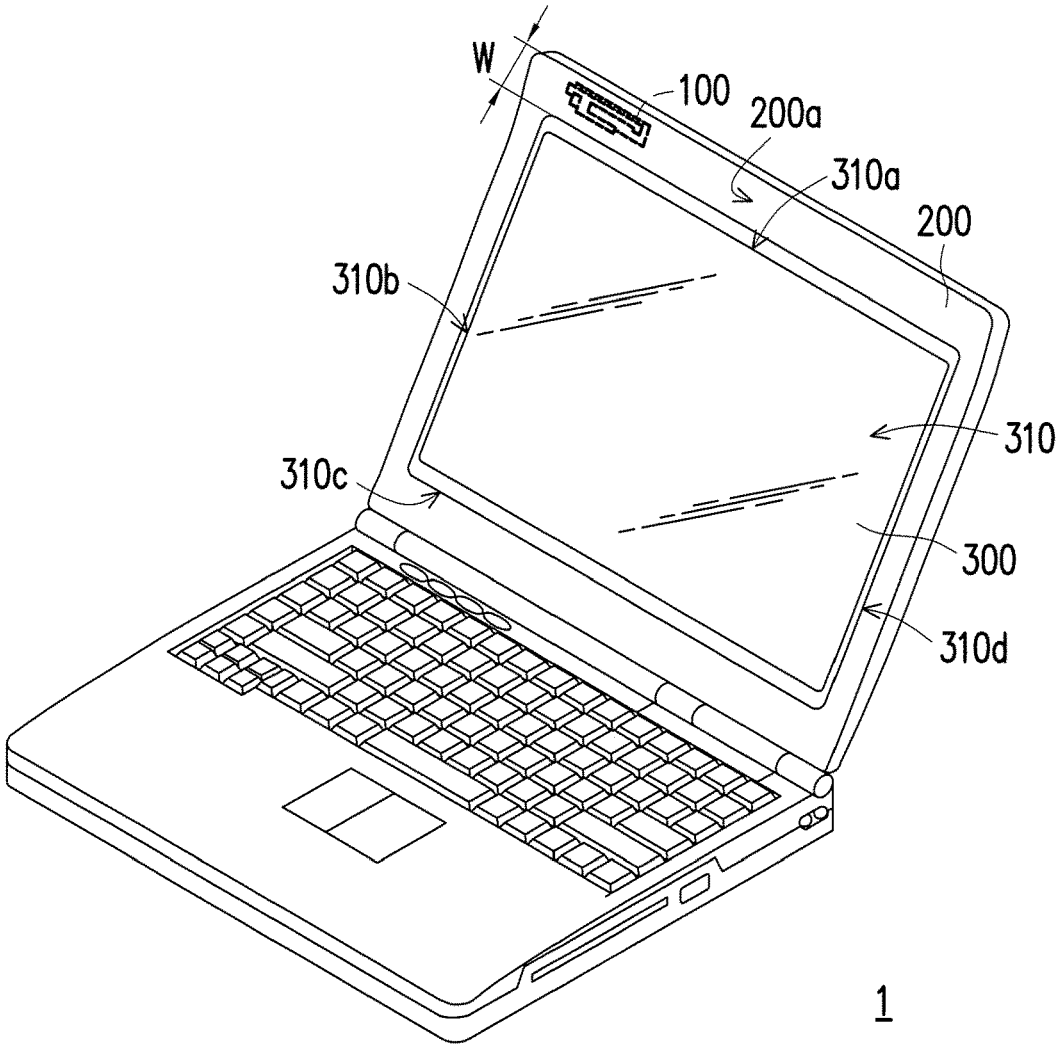
FIG. 5 is a schematic view of an electronic device in an embodiment.

FIG. 5 is a schematic view of an electronic device in an embodiment of the present invention. Referring to FIG. 5, the electronic device 1 includes a housing 200 and an antenna 100 installed in the housing 200. The antenna ground plane 110 is located between the radiating unit 120 and the housing 200. In an embodiment, the electronic device is a notebook or a tablet computer, and the housing is a cover of a notebook or a tablet computer, which is not limited herein. In an embodiment, the electronic device is a smartphone, or a smart television including the housing 200 and the antenna 100. In an embodiment, the housing 200 of the electronic device 1 is a metal, and the antenna ground plane 100 is electronically connected to the metal housing 200, which is not limited herein.

Figure 6:
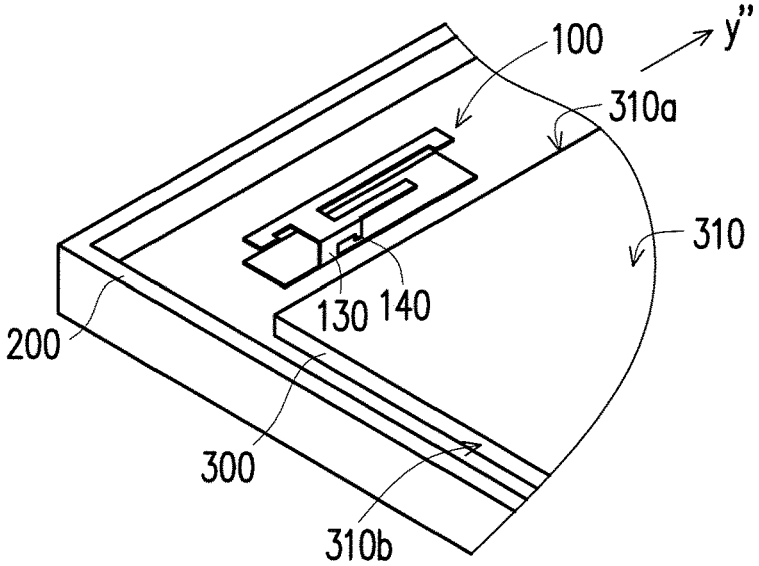
FIG. 6 is a schematic diagram showing a portion of the housing, the antenna and the display unit of the electronic device of FIG. 5.

Referring to FIG. 5, the electronic device 1 of the embodiment further includes a display unit 300 installed in the housing 200. FIG. 6 is a schematic diagram showing a portion of the housing 200, the antenna 100 and the display unit 300 of the electronic device 1 of FIG. 5. For the charity, the top surface 200*a* parallel to the rectangle display surface 310 of the housing 200 is not shown in FIG. 5. Referring to FIG. 5 and FIG. 6, the display unit 300 includes a rectangle display surface 310. The rectangle display surface 310 has four edges 310*a*, 310*b*, 310*c* and 310*d*. The antenna 100 is next to the edge 310*a* of the rectangle display surface 310 among the edge 310*a*, 310*b*, 310*c* and 310*d*. The arrangement direction y" of the shorting unit 130 and the feeding unit 140 are parallel to the edge 310*a*. Consequently, when the distance s between the shorting unit 130 and the feeding unit 140 is adjusted to compensate for the high capacitive reactance value between the antenna ground plane 110 and the radiating unit 120, the increase distance s would not affect the width W of the board of the electronic device 1. In other words, the electronic device 1 using the antenna 100 can be in a thin type, while the antenna 100 has good performance of receiving and transmitting signals.

In conclusion, in an antenna according to an embodiment, the first branch of the radiating unit extends from the common unit along a first direction, the second branch of the radiating unit extends from the common unit along a second direction, the first direction and the second direction are inverse. The shorting unit and the feeding unit are located on the same side. Since the shorting unit and the feeding unit are located on the same side of the whole antenna, the high capacitive reactance value generated due to the low height between the antenna ground plane and the radiating unit is easily compensated by adjusting the distance between the short unit and the feeding unit. As a result, the antenna has a good performance even when height of the antenna is reduced, which is more elastic in design.

Although the invention has been disclosed with reference to certain embodiments thereof, the disclosure is not for limiting the scope. Persons having ordinary skill in the art may make various modifications and changes without departing from the scope of the invention. Therefore, the scope of the appended claims should not be limited to the description of the embodiments described above.

What is claimed is:

1. An antenna including:

an antenna ground plane;

a radiating unit parallel to the antenna ground plane, the radiating unit including:

a common unit;

a first branch extended from the common unit along a first direction;

a second branch extended from the common unit along a second direction, wherein the first direction and the second direction are inverse, the first branch includes a first length in the first direction, the second branch includes a second length in the second direction, and the first length is greater than the second length; and a third branch separated from the first branch and the second branch and extending outwardly from the common unit, wherein the second branch and the third branch are not aligned in the second direction, the first branch and the third branch are located at a same side of the common unit, and a plane of the first branch, the second branch, the third branch and the common unit is parallel to a plane of the antenna ground plane;

a shorting unit located between a plane of the radiating unit and a plane of the antenna ground plane, wherein two opposite sides of the shorting unit are parallel to each other and are directly connected to the common unit of the radiating unit and the antenna ground plane, respectively; and a feeding unit located between a plane of the radiating unit and a plane of the antenna ground plane, wherein the feeding unit is separated from the shorting unit and connected to the third branch, the third branch extends over the feeding unit, the shorting unit and the feeding unit are located on the same side, and a plane of the feeding unit and the shorting unit is perpendicular to the plane of the antenna ground plane.

2. The antenna according to claim 1, wherein the third branch extends from the common unit to a third direction, and the third direction is parallel to the first direction.

3. The antenna according to claim 1, wherein the first length of the first branch, the second length of the second branch and a third length of the third branch are different from each other.

4. The antenna according to claim 1, wherein the antenna ground plane, the radiating unit, the shorting unit and the feeding unit are integrally formed.

5. The antenna according to claim 1, wherein the first branch and the second branch are located at a same straight line.

6. The antenna according to claim 1, wherein the second branch and the third branch are not overlapped in the second direction in a projection view.

7. An electronic device, including:

a housing, and an antenna, including:

an antenna ground plane;

a radiating unit parallel to the antenna ground plane, the radiating unit including:

a common unit;

a first branch extended from the common unit along a first direction;

a second branch extended from the common unit along a second direction, wherein the first direction and the second direction are inverse, the first branch includes a first length in the first direction, the second branch includes a second length in the second direction, and the first length is greater than the second length; and a third branch separated from the first branch and the second branch and extending outwardly from the common unit, wherein the second branch and the third branch are not aligned in the second direction, the first branch and the third branch are located at a same side of the common unit, and a plane of the first branch, the second branch, the third branch and the common unit is parallel to a plane of the antenna ground plane;

a shorting unit located between a plane of the radiating unit and a plane of the antenna ground plane, wherein two opposite sides of the shorting unit are parallel to each other and are directly connected to the common unit of the radiating unit and the antenna ground plane, respectively; and a feeding unit located between a plane of the radiating unit and a plane of the antenna ground plane, wherein the feeding unit is separated from the shorting unit and connected to the third branch, the third branch extends over the feeding unit, the shorting unit and the feeding unit are located on the same side, and a plane of the feeding unit and the shorting unit is perpendicular to the plane of the antenna ground plane.

8. The electronic device according to claim 7, wherein the housing is a metallic housing.

9. The electronic device according to claim 7, further including a display installed in the housing.

10. The electronic device according to claim 9, wherein the display includes a rectangle display surface, the rectangle display surface includes four edges, the antenna is configured next to one of the edges, and the arrangement direction of the feeding unit and the shorting unit is parallel to the one of the edges.

11. The electronic device according to claim 7, wherein the third branch extends from the common unit towards a third direction, and the third direction is parallel to the first direction.

12. The electronic device according to claim 7, wherein the third branch includes a third length, the first length, the second length and the third length are different from each other.

13. The electronic device according to claim 7, wherein the antenna ground plane, the radiating unit, the shorting unit and the feeding unit are integrally formed.

14. The electronic device according to claim 7, wherein the first branch and the second branch are located at a same straight line.

15. An antenna including:

an antenna ground plane;

a radiating unit parallel to the antenna ground plane, the radiating unit including:

a common unit;

a first branch extended from the common unit along a first direction;

a second branch extended from the common unit along a second direction, wherein the first direction and the second direction are inverse, the first branch includes a first length, the second branch includes a second length, and the first length is greater than the second length; and a third branch separated from the first branch and the second branch and extending outwardly from the common unit, wherein the second branch and the third branch are not aligned in the second direction, the first branch and the third branch are located at a same side of the common unit the first branch and the third branch are located at a same side of the common unit, and a plane of the first branch, the second branch, the third branch and the common unit is parallel to a plane of the antenna ground plane;

a shorting unit located between a plane of the radiating unit and a plane of the antenna ground plane, wherein the plane of the radiating unit and the plane of the antenna ground plane are not coplanar, two opposite sides of the shorting unit are parallel to each other and are directly connected to the common unit of the radiating unit and the antenna ground plane, respectively; and a feeding unit located between a plane of the radiating unit and a plane of the antenna ground plane, wherein the feeding unit is separated from the shorting unit and connected to the third branch, the third branch extends over the feeding unit, the shorting unit and the feeding unit are located on the same side, and a plane of the feeding unit and the shorting unit is perpendicular to the plane of the antenna ground plane.

* * * * *